US008568149B1

(12) United States Patent
Vackar et al.

(10) Patent No.: US 8,568,149 B1
(45) Date of Patent: Oct. 29, 2013

(54) CONNECTOR BLOCK FOR COAXIAL CONNECTORS

(75) Inventors: Mark A. Vackar, Round Rock, TX (US); Bruce R. Perry, Georgetown, TX (US)

(73) Assignee: National Instruments Corporation, Austin, TX (US)

( * ) Notice: Subject to any disclaimer, the term of this patent is extended or adjusted under 35 U.S.C. 154(b) by 0 days.

(21) Appl. No.: 13/469,710

(22) Filed: May 11, 2012

(51) Int. Cl.
*H01R 12/00* (2006.01)

(52) U.S. Cl.
USPC ..... 439/63

(58) Field of Classification Search
USPC ..... 439/63, 579, 578, 581
See application file for complete search history.

(56) References Cited

U.S. PATENT DOCUMENTS

| | | | | |
|---|---|---|---|---|
| 5,004,430 | A | 4/1991 | DelGuidice et al. | |
| 7,326,063 | B1 | 2/2008 | Raudenbush et al. | |
| 7,374,427 | B2 * | 5/2008 | Kodaira et al. | 439/63 |
| D607,143 | S * | 12/2009 | Sugishita et al. | D26/121 |
| D625,691 | S * | 10/2010 | Kondo | D13/154 |
| 7,927,156 | B2 * | 4/2011 | Appel et al. | 439/709 |
| 2006/0025014 | A1 | 2/2006 | Spink, Jr. | |
| 2006/0211303 | A1 * | 9/2006 | Kodaira et al. | 439/579 |
| 2007/0111596 | A1 * | 5/2007 | Weidner et al. | 439/581 |
| 2009/0197434 | A1 * | 8/2009 | Kressner et al. | 439/63 |
| 2010/0176896 | A1 * | 7/2010 | Payne | 333/33 |

* cited by examiner

*Primary Examiner* — Phuong Dinh
(74) *Attorney, Agent, or Firm* — Meyertons Hood Kivlin Kowert & Goetzel, P.C.; Jeffrey C. Hood; Mark S. Williams

(57) ABSTRACT

Connector block for connecting a panel mount coaxial connector to a circuit board. The connector block is electrically conductive, and includes one or more connector slots, each configured to receive a respective coaxial connector that includes an external connection for electrically connecting to a respective complementary coaxial connector of a coaxial cable, and an internal connection for electrically connecting to a trace on a circuit board. The connector block further includes one or more ground pads, each proximate to a respective connector slot. For each of the one or more ground pads, when the panel mount coaxial connector is inserted into the connector slot, the ground pad provides a ground connection to a panel mount coaxial connector, and when the connector block is installed on the circuit board, the ground pad connects to a respective specified ground point on the circuit board, thereby grounding the corresponding panel mount coaxial connector.

20 Claims, 6 Drawing Sheets

CONNECTOR BLOCK FOR COAXIAL CONNECTORS

FIELD OF THE INVENTION

The present invention relates to the field of hardware connections, and more particularly to a coaxial connector block and its use.

DESCRIPTION OF THE RELATED ART

Various types of electrical connectors are used to interconnect hardware devices and components, with each type directed to particular requirements or desired features. One particularly common connector is for connecting to coaxial cables, and is accordingly referred to as coaxial connector.

Subminiature type A (SMA) connectors are coaxial connectors commonly used in radio frequency (RF) products, e.g., devices that operate or communicate via signals in the radio frequency range (e.g., ~3 kHz-300 GHz). Such connectors are generally used with coaxial cables and maintain the shielding functionality provided by the cables. Additionally, such connectors generally provide physical means for securing the connector to a device or component, e.g., threads, bayonet, braces, push pull, and so forth. There are a myriad of different designs for this type of connector that all try to balance ease of assembly with losses to the signal being transmitted through the connector. These designs can be divided into two basic categories, panel or shield mount connectors, and board mount connectors. Note that for the purposes of this presentation, the terms "panel" and "shield" may be used interchangeably; however, when discussed in a context where differences between the two are significant, the specific term will be used. Each of these types has its benefits and weaknesses.

FIGS. 1A and 1B illustrate external and internal views of exemplary panel mount connectors 10 installed on a plate (i.e., a shield or panel) 11 of a device 120A (which may be a module for use in another device), according to the prior art.

As may be seen, FIG. 1A shows several panel mount coaxial connectors 10 installed on a plate 11 (in this case a shield) of a device 120A that includes a circuit board 14A, referred to as a circuit card assembly (CCA) or printed circuit board (PCB). A primary benefit of the panel mount connector 10 is that it seals the opening that is created in the panel for the connector; the opening is sealed by the connector body mounting to the panel and filling or covering the opening. The fact that this type of connector is mounted to the panel also causes its weaknesses. First, note that since the connector 10 is mounted to the plate it cannot be installed until the plate is installed, making it difficult to test the CCA. Secondly, and more importantly, the ground return path for the connector body must pass through the plate to return to the CCA where the connector is mounted. This can result in a somewhat lengthy and uncertain ground return path. For example, in FIG. 1B, which shows an inside view of the assembly of FIG. 1A, for each of the panel mount connectors 10 installed on the panel/shield there is a connector signal pin soldered to the CCA 14. Note that each connector is grounded to the plate, and the CCA is electrically grounded via any and all points of contact between the exposed ground plane of the CCA and the plate or other shields that are or will be connected to the plate or CCA. This makes the ground connection(s) for the CCA ill-defined or ambiguous, and generally circuitous, and can lead to unintended phenomena during operation. In other words, minor variations in the surface of the circuit board and the connector block may cause the precise point of contact to change from one assembly to another. For this reason there can be variation in the ground return path from one board to another that causes variation in performance.

FIG. 1C shows board mount coaxial connectors 12 mounted on a circuit board or CCA 14B. The main benefit of a board mounted connector is that it is mounted directly to the CCA, thereby providing a very short ground return path to the connector. Moreover, the connector can be mounted to the CCA without the panel (or shield(s)) making it much easier to test the CCA. The primary weakness of this type of connector is that it does not provide a simple reliable method for sealing the opening in the panel or shield (e.g., which is required for the coaxial cable to exit the device/chassis). FIG. 1D illustrates the CCA of FIG. 1C enclosed within a plate or shield assembly, where, as may be seen, there are gaps around each connector, which allows EMI (electromagnetic interference) leakage.

SUMMARY OF THE INVENTION

Various embodiments of a connector block for coaxial connectors are presented below.

A connector block for connecting a panel mount coaxial connector to a circuit board may be provided. The connector block may include an electrically conductive block, including one or more connector slots, each configured to receive a respective coaxial connector that includes an external connection configured to electrically connect to a respective complementary coaxial connector of a coaxial cable, and an internal connection configured to electrically connect to a respective trace on a circuit board. The connector block may further include one or more ground pads, each ground pad being proximate to a respective connector slot.

For each of the one or more ground pads, when the panel mount coaxial connector is inserted into the connector slot, the ground pad may provide a ground connection to a panel mount coaxial connector. Moreover, when the connector block is installed on the circuit board, the ground pad may connect to a respective specified ground point on the circuit board, thereby grounding the corresponding panel mount coaxial connector.

In one embodiment, when the connector block is installed on the circuit board the one or more ground pads may connected to the respective specified ground points via any of a variety of connection means as desired, including for example, conductive bonding or conductive screws, among others.

Moreover, in various embodiments, the coaxial connectors may be any of a variety of connector types. For example, in one embodiment, the one or more panel mount coaxial connectors may be or include one or more panel mount RF (radio frequency) connectors, e.g., one or more panel mount Sub-Miniature connectors. In one exemplary embodiment, the one or more panel mount coaxial connectors may be or include one or more panel mount SubMiniature version A (SMA) connectors. Note, however, that in other embodiments, any types of panel mount coaxial connectors can be used as desired. Examples of other coaxial connectors that may be used include, but are not limited to, SubMiniature version B (SMB), SubMiniature version C (SMC), SubMiniature Push-On (SMP), Micro Coaxial (MCX), and Micro-Miniature Coaxial MMCX connectors. Note that any other coaxial connector types may be used as desired.

Note further that in some embodiments the one or more panel mount coaxial connectors are male connectors, and thus, the complementary coaxial connectors are female connectors. Alternatively, the one or more panel mount coaxial connectors may be female connectors, and the complementary coaxial connectors may be male connectors. Of course, any combinations of male and female connectors may be used as desired.

Thus, the connector block may electrically connect to the CCA (or PCB) at specific points, thereby providing a consistent point of ground contact close to the connector bodies (and also close to the points at which the connector signal pins are soldered to the CCA), and resulting in improved shielding of the signal being transmitted through the connector. Moreover, by providing the ground pads at correct locations and connecting the pad(s) to the circuit board at these specified locations, manufacturers and users can be assured that the ground return path is as short as possible and consistent from board to board.

In one embodiment, one or more panel mount coaxial connectors may be installed in the connector block, and the connector block may be installed on a circuit board. Note that the two installation steps may be performed in any order, or even simultaneously, as desired.

One or more tests may be performed on the circuit board using the one or more panel mount coaxial connectors, where during the tests, the circuit board may not be installed in a device, or the connector block may not be installed in or on a plate of the device. In one embodiment, the connector block and circuit board may be installed in a device, where the device is connectable to one or more other devices via the one or more panel mount coaxial connectors of the connector block. Additionally, the device may be connected to at least one other device via the one or more panel mount coaxial connectors of the connector block, and the device may be operated in conjunction with the at least one other device.

Thus, various embodiments of the connector block described herein may provide improved means for connecting coaxial cables to circuit boards that facilitate testing of the circuit boards.

BRIEF DESCRIPTION OF THE DRAWINGS

A better understanding of the present invention can be obtained when the following detailed description of the preferred embodiment is considered in conjunction with the following drawings, in which.

Figure 1A:
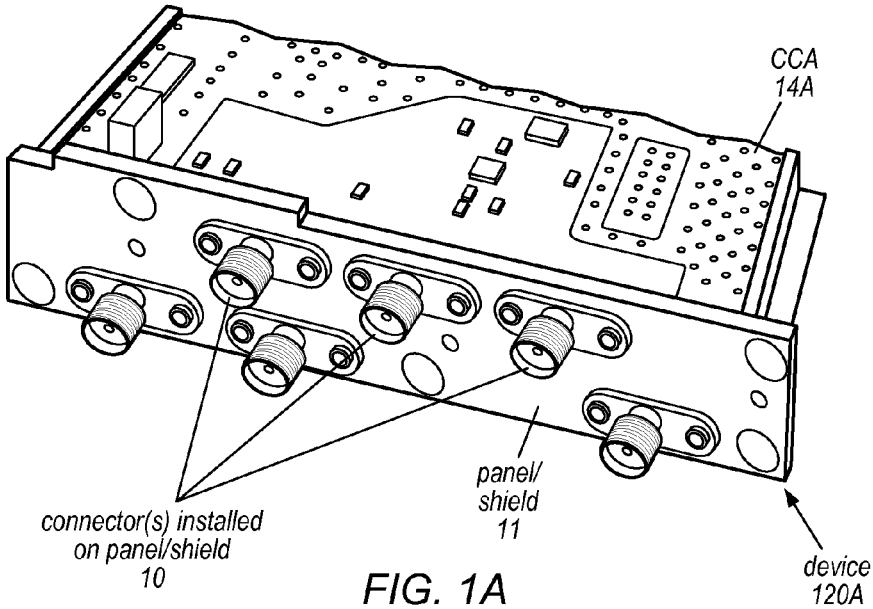
FIG. 1A (Prior Art)
FIGS. 1A and 1B illustrate panel mount coaxial connectors and their use, according to the prior art.
Figure 1B:
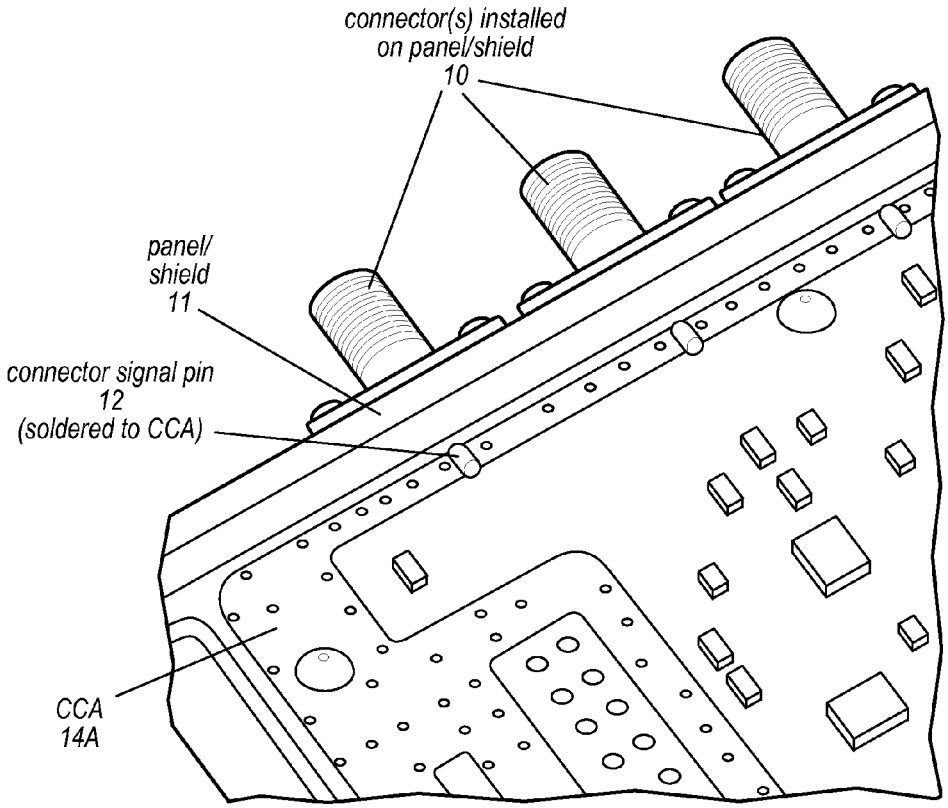
FIG. 1B (Prior Art)
Figure 1C:
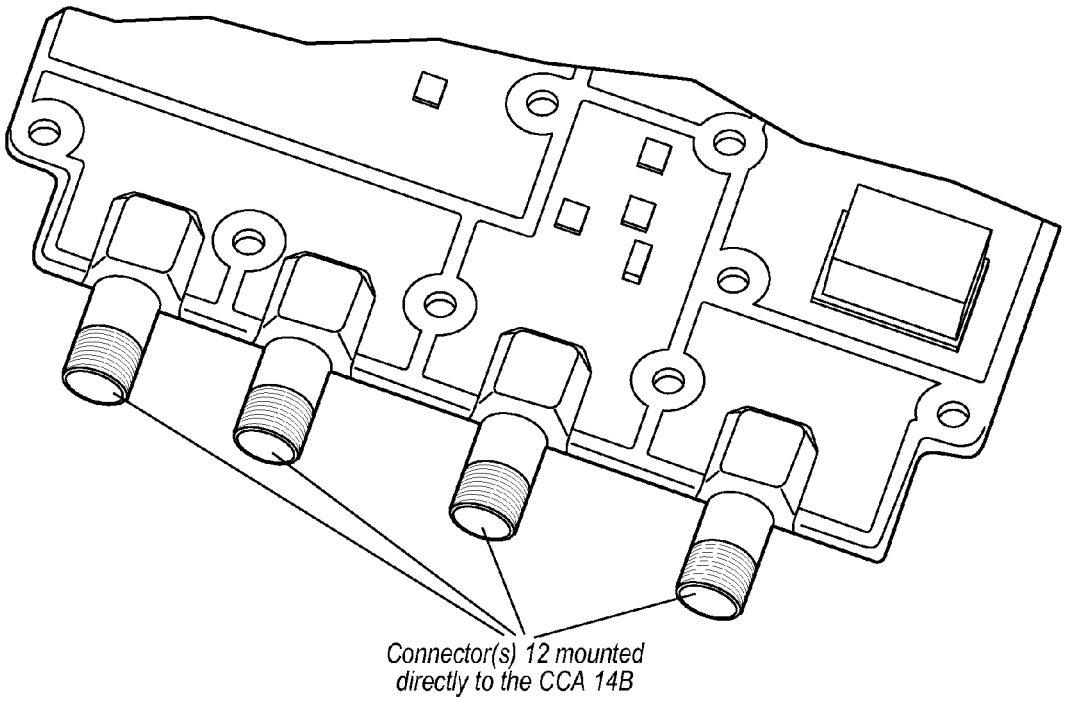
FIG. 1C (Prior Art)
FIGS. 1C and 1D illustrate board mount coaxial connectors and their use, according to the prior art.
Figure 1D:
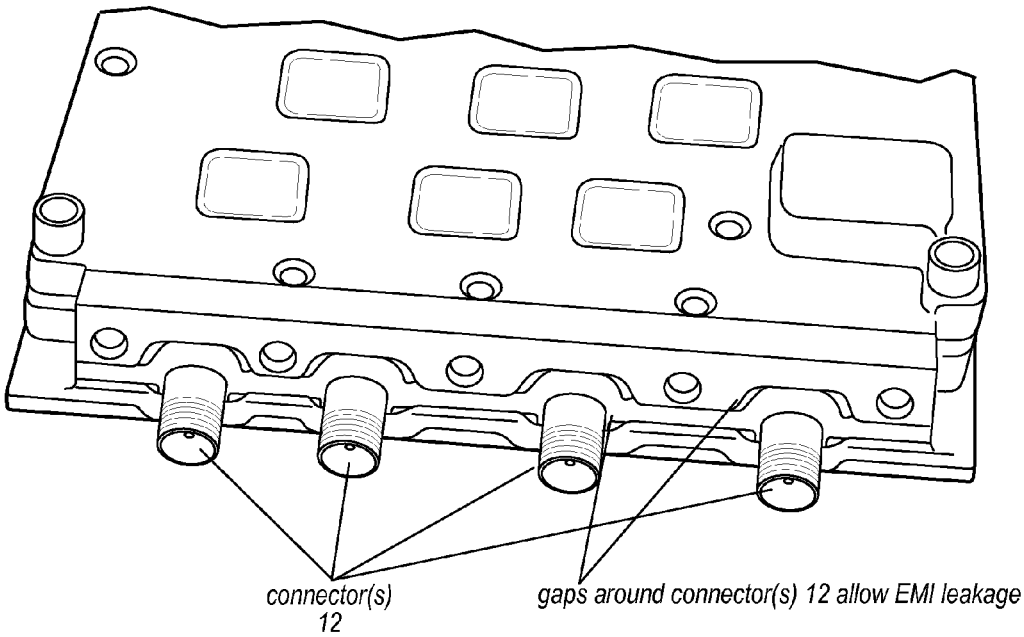
FIG. 1D (Prior Art)

While the invention is susceptible to various modifications and alternative forms, specific embodiments thereof are shown by way of example in the drawings and are herein described in detail. It should be understood, however, that the drawings and detailed description thereto are not intended to limit the invention to the particular form disclosed, but on the contrary, the intention is to cover all modifications, equivalents, and alternatives falling within the spirit and scope of the present invention as defined by the appended claims.

DETAILED DESCRIPTION OF THE INVENTION

Terms

The following is a glossary of terms used in the present application:

Computer System—any of various types of computing or processing systems, including a personal computer system (PC), mainframe computer system, workstation, network appliance, Internet appliance, personal digital assistant (PDA), television system, grid computing system, or other device or combinations of devices. In general, the term "computer system" can be broadly defined to encompass any device (or combination of devices) having at least one processor that executes instructions from a memory medium.

Measurement Device—includes instruments, data acquisition devices, smart sensors, and any of various types of devices that are configured to acquire and/or store data. A measurement device may also optionally be further configured to analyze or process the acquired or stored data. Examples of a measurement device include an instrument, such as a traditional stand-alone "box" instrument, a computer-based instrument (instrument on a card) or external instrument, a data acquisition card, a device external to a computer that operates similarly to a data acquisition card, a smart sensor, one or more DAQ or measurement cards or modules in a chassis, an image acquisition device, such as an image acquisition (or machine vision) card (also called a video capture board) or smart camera, a motion control device, a robot having machine vision, and other similar types of devices. Exemplary "stand-alone" instruments include oscilloscopes, multimeters, signal analyzers, arbitrary waveform generators, spectroscopes, and similar measurement, test, or automation instruments.

A measurement device may be further configured to perform control functions, e.g., in response to analysis of the acquired or stored data. For example, the measurement device may send a control signal to an external system, such as a motion control system or to a sensor, in response to particular data. A measurement device may also be configured to perform automation functions, i.e., may receive and analyze data, and issue automation control signals in response.

Automatically—refers to an action or operation performed by a computer system (e.g., software executed by the computer system) or device (e.g., circuitry, programmable hardware elements, ASICs, etc.), without user input directly specifying or performing the action or operation. Thus the term "automatically" is in contrast to an operation being manually performed or specified by the user, where the user provides input to directly perform the operation. An automatic procedure may be initiated by input provided by the user, but the subsequent actions that are performed "automatically" are not specified by the user, i.e., are not performed "manually", where the user specifies each action to perform. For example, a user filling out an electronic form by selecting each field and providing input specifying information (e.g., by typing information, selecting check boxes, radio selections, etc.) is filling out the form manually, even though the computer system must update the form in response to the user actions. The form may be automatically filled out by the computer system where the computer system (e.g., software executing on the computer system) analyzes the fields of the form and fills in the form without any user input specifying the answers to the fields. As indicated above, the user may invoke the automatic filling of the form, but is not involved in the actual filling of the form (e.g., the user is not manually specifying answers to fields but rather they are being automatically completed). The present specification provides various examples of operations being automatically performed in response to actions the user has taken.

Exemplary Systems

Embodiments of the present invention may be involved with performing test and/or measurement functions; controlling and/or modeling instrumentation or industrial automation hardware; modeling and simulation functions, e.g., modeling or simulating a device or product being developed or tested, etc. Exemplary test applications include hardware-in-the-loop testing and rapid control prototyping, among others.

However, it is noted that embodiments of the present invention can be used for a plethora of applications and is not limited to the above applications. In other words, applications discussed in the present description are exemplary only, and embodiments of the present invention may be used in any of various types of systems. Thus, embodiments of the system and method of the present invention is configured to be used in any of various types of applications, including the control of other types of devices such as multimedia devices, video devices, audio devices, telephony devices, Internet devices, etc.

Figure 2A:
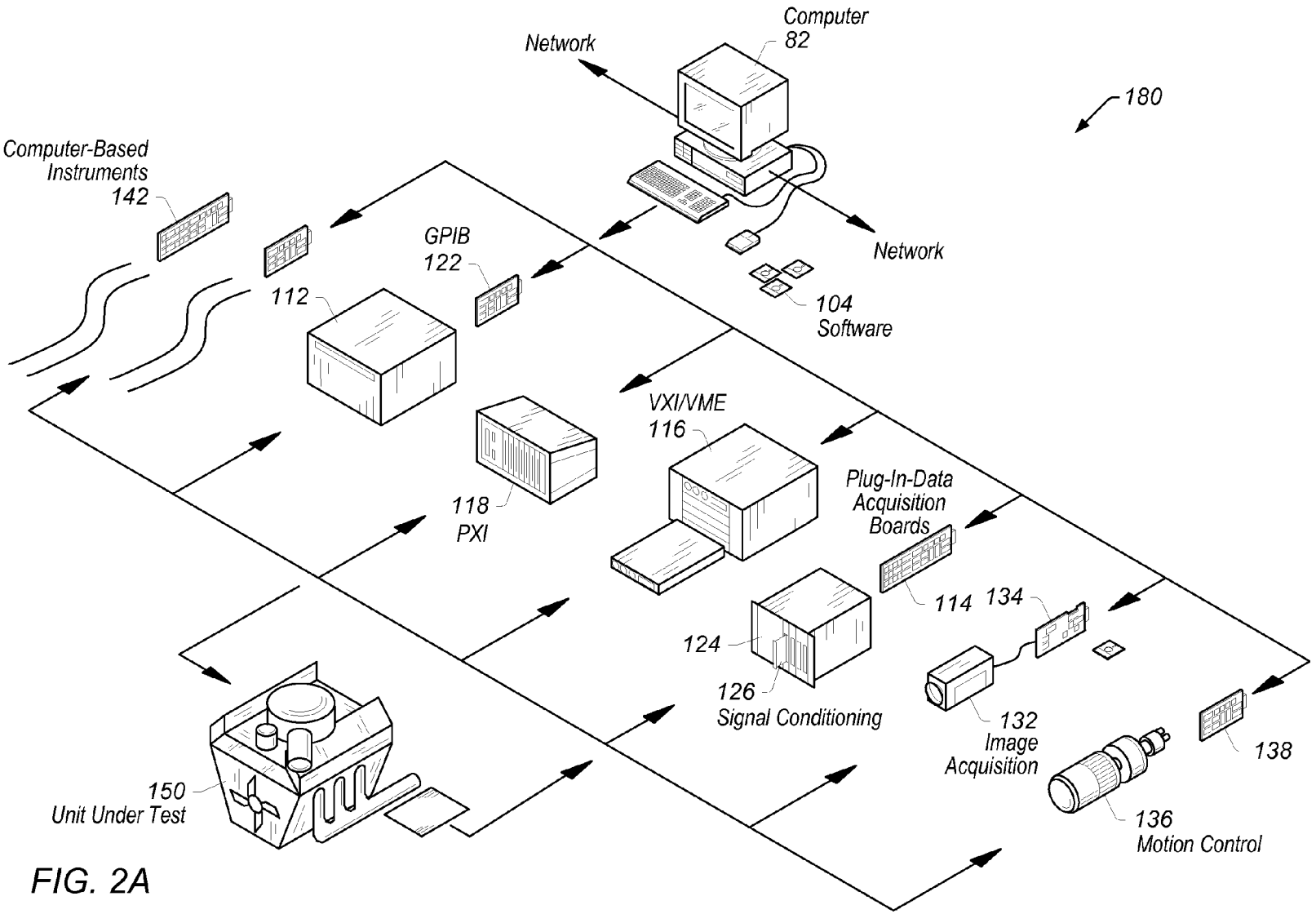
FIG. 2A illustrates an instrumentation control system, according to one embodiment of the invention.

FIG. 2A illustrates an exemplary instrumentation control system 180 which may implement embodiments of the invention. The system 180 comprises a host computer 82 which couples to one or more instruments. The host computer 82 may comprise a CPU, a display screen, memory, and one or more input devices such as a mouse or keyboard as shown. The computer 82 may coupled to and operate with the one or more instruments to analyze, measure or control a unit under test (UUT) or process 150. The computer 82 and/or the one or more instruments may utilize a connector block for coaxial connectors as disclosed herein, according to some embodiments.

The one or more instruments may include a GPIB instrument 112 and associated GPIB interface card 122, a data acquisition board 114 inserted into or otherwise coupled with chassis 124 with associated signal conditioning circuitry 126, a VXI instrument 116, a PXI instrument 118, a video device or camera 132 and associated image acquisition (or machine vision) card 134, a motion control device 136 and associated motion control interface card 138, and/or one or more computer based instrument cards 142, among other types of devices. The instruments may be coupled to the unit under test (UUT) or process 150 (e.g., using an embodiment of the connector block), or may be coupled to receive field signals, typically generated by transducers. The system 180 may be used in a data acquisition and control application, in a test and measurement application, an image processing or machine vision application, a process control application, a man-machine interface application, a simulation application, or a hardware-in-the-loop validation application, among others.

Figure 2B:
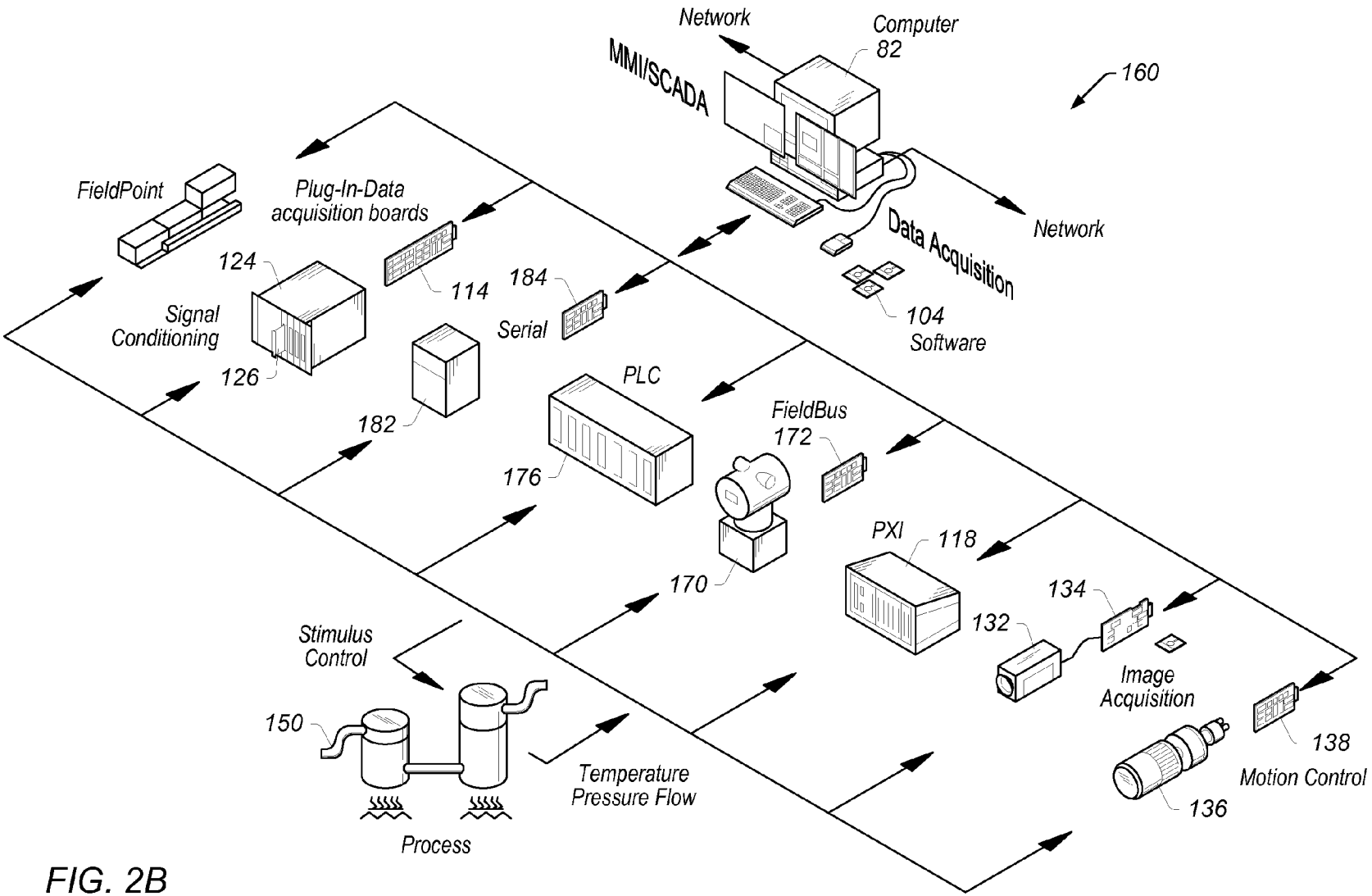
FIG. 2B illustrates an industrial automation system, according to one embodiment of the invention.

FIG. 2B illustrates an exemplary industrial automation system 160 which may implement embodiments of the invention. The industrial automation system 160 is similar to the instrumentation or test and measurement system 180 shown in FIG. 2A. Elements which are similar or identical to elements in FIG. 2A have the same reference numerals for convenience. The system 160 may comprise a computer 82 which couples to one or more devices or instruments. As with the system of FIG. 2A, the computer 82 and/or the one or more instruments may utilize a connector block for coaxial connectors as disclosed herein, according to some embodiments. The computer 82 may comprise a CPU, a display screen, memory, and one or more input devices such as a mouse or keyboard as shown. The computer 82 may operate with the one or more devices to perform an automation function with respect to a process or device 150, such as MMI (Man Machine Interface), SCADA (Supervisory Control and Data Acquisition), portable or distributed data acquisition, process control, advanced analysis, or other control, among others.

The one or more devices may include a data acquisition board 114 inserted into or otherwise coupled with chassis 124 with associated signal conditioning circuitry 126, a PXI instrument 118, a video device 132 and associated image acquisition card 134, a motion control device 136 and associated motion control interface card 138, a fieldbus device 170 and associated fieldbus interface card 172, a PLC (Programmable Logic Controller) 176, a serial instrument 182 and associated serial interface card 184, or a distributed data acquisition system, such as the Fieldpoint system available from National Instruments, among other types of devices.

Connector Block for Panel Mount Coaxial Connectors

Figure 3:
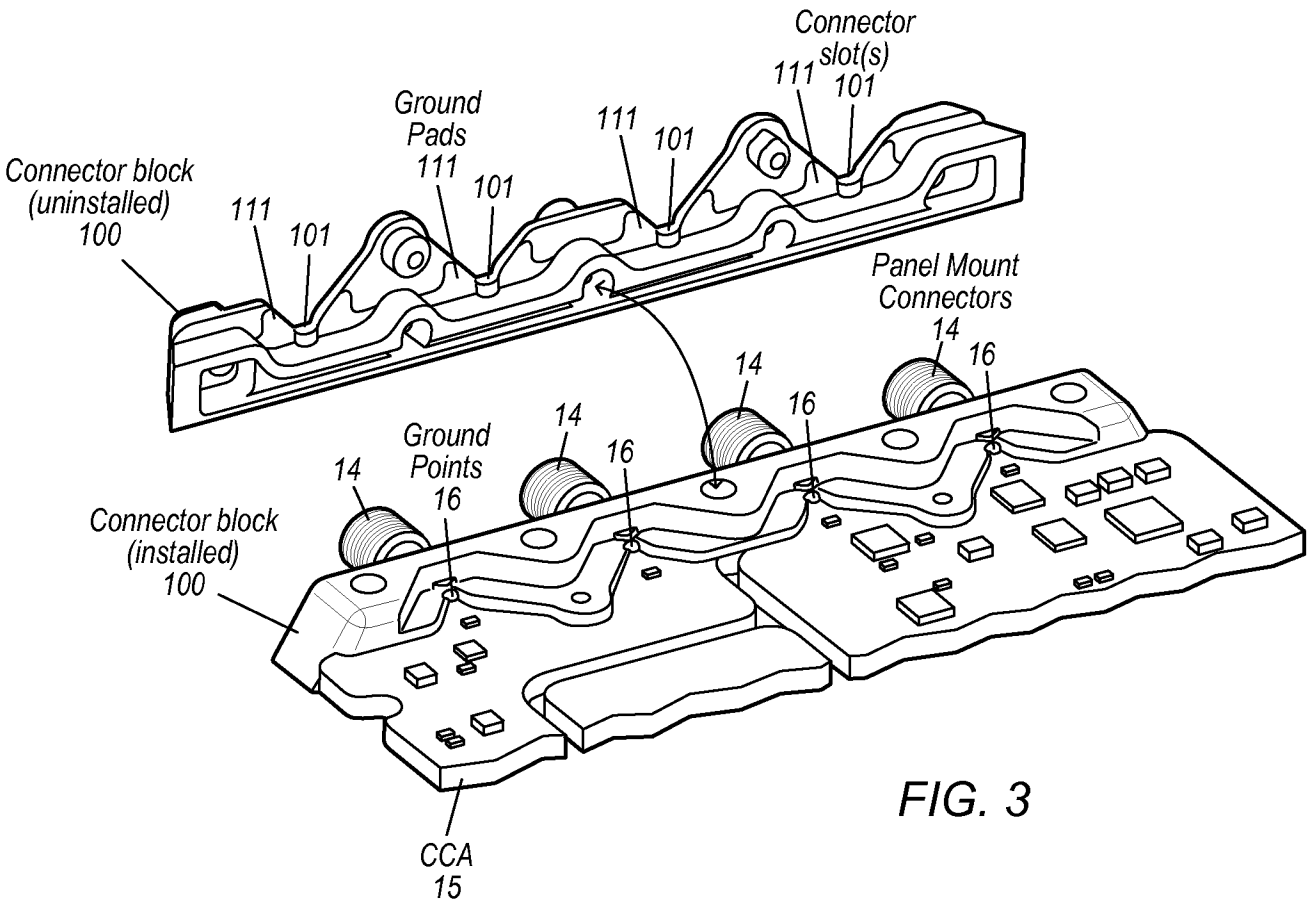
FIG. 3 illustrates a connector block for coaxial connectors and its installation on a circuit board, according to one embodiment.

FIG. 3 illustrates a connector block 100 for panel mount coaxial connectors 14 and its installation on a circuit board (showing the connector block both uninstalled and installed), according to one embodiment. In some embodiments, the connector block is an electrically conductive block. The connector block may include one or more connector slots 101, where each connector slot 101 is configured to receive a respective panel mount coaxial connector 14. Of course, in other embodiments, the connector block may include a plurality of connector slots 101, as shown in FIG. 3.

The coaxial connectors 14 (which the connector block's one or more connector slots are configured to receive) may each include an external connection configured to electrically connect to a respective complementary coaxial connector of a coaxial cable, and an internal connection configured to electrically connect to a respective trace on a circuit board. Note that in one embodiment, when inserted into a connector slot the external connection also makes contact with the connector block, thereby providing a ground connect.

As FIG. 3 also indicates, the connector block may further include one or more ground pads 111, where each ground pad is proximate to (near) a respective connector slot. In the particular embodiment shown, there are actually two ground pads per connector slot, although in other embodiments, any number (greater than 0) of ground pads 111 may be provided or used for each connector slot 101, as desired.

Each of the ground pads may be configured such that when the panel mount coaxial connector is inserted into the connector slot, the ground pad provides a ground connection to a panel mount coaxial connector. Moreover, when the connector block is installed on the circuit board, the ground pad may connect to a respective specified ground point on the circuit board, thereby grounding the corresponding panel mount coaxial connector, via a direct (and thus very short) ground path.

Thus, by providing ground pads (proximate to each connector/connector slot) for connection to the CCA a specified locations, the ground path for each connector is well defined, and being very short, prevents many (if not all) unintended phenomena associated with long, circuitous, or ambiguous ground paths for coaxial connectors.

As noted above, FIG. 3 shows the connector block both uninstalled and installed on the CCA. Note that when installed the connector block may be connected to the CCA via any of a variety of means. For example, in some embodiments, when the connector block is installed on the circuit board (CCA) the one or more ground pads may be connected to the respective specified ground points via conductive bonding, e.g., conductive epoxy, solder, etc. In other embodiments, when the connector block is installed on the circuit board the one or more ground pads may be connected to the respective specified ground points via conductive screws (possibly in addition to conductive bonding). Note that any other electrically conductive means for connecting the ground pads of the connector block to the CCA (at the specified ground points) may be used as desired.

Moreover, in various embodiments, the coaxial connectors may be any of a variety of connector types. For example, in one embodiment, the one or more panel mount coaxial connectors may be or include one or more panel mount RF (radio frequency) connectors, e.g., one or more panel mount Sub-Miniature connectors. In one exemplary embodiment, the one or more panel mount coaxial connectors may be or include one or more panel mount SubMiniature version A (SMA) connectors. Note, however, that in other embodiments, any types of panel mount coaxial connectors can be used as desired. Examples of other coaxial connectors that may be used include, but are not limited to, SubMiniature version B (SMB), SubMiniature version C (SMC), SubMiniature Push-On (SMP), Micro Coaxial (MCX), and Micro-Miniature Coaxial MMCX connectors. Note that any other coaxial connector types may be used as desired.

Note further that in some embodiments the one or more panel mount coaxial connectors are male connectors, and thus, the complementary coaxial connectors are female connectors. Alternatively, the one or more panel mount coaxial connectors may be female connectors, and the complementary coaxial connectors may be male connectors. Of course, any combinations of male and female connectors may be used as desired.

Thus, the connector block may electrically connect to the CCA (or PCB) at specific points, thereby providing a consistent point of ground contact close to the connector bodies (and also close to the points at which the connector signal pins are soldered to the CCA), and resulting in improved shielding of the signal being transmitted through the connector. Moreover, by providing the ground pads at correct locations and connecting the pad(s) to the circuit board at these specified locations, manufacturers and users can be assured that the ground return path is as short as possible and consistent from board to board.

Figure 4:
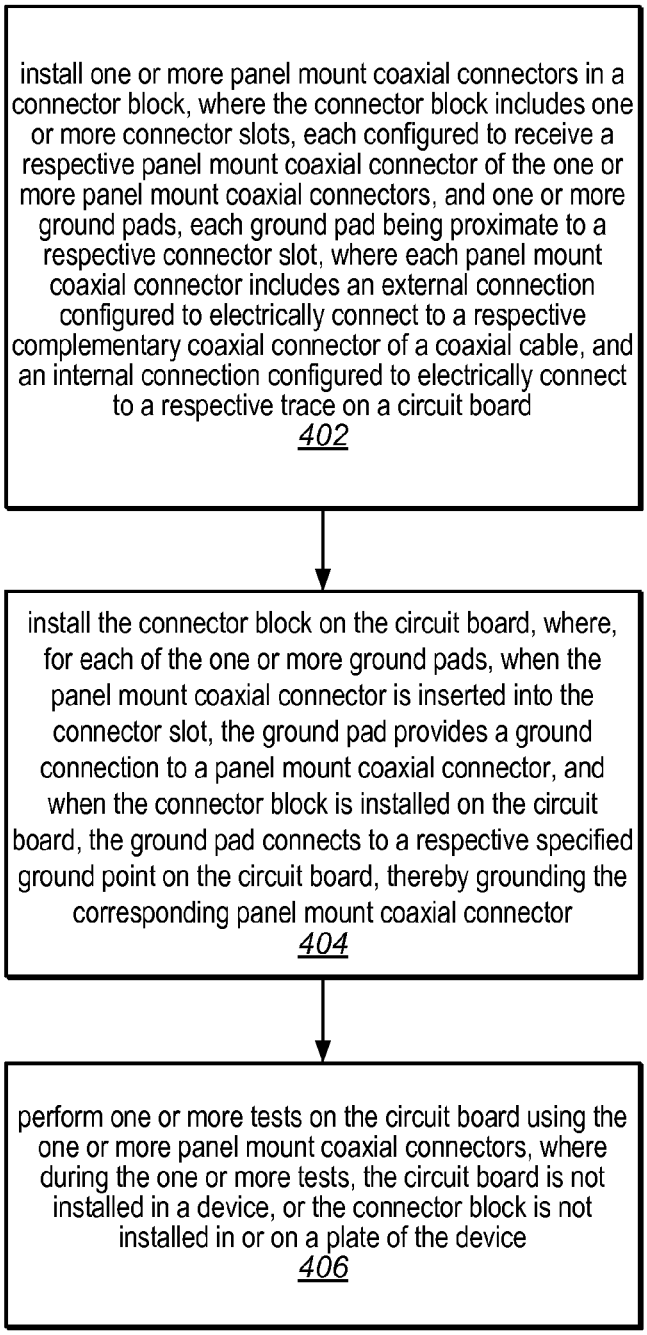
FIG. 4 is a flowchart diagram illustrating one embodiment of a method for using a connector block with coaxial connectors, according to one embodiment.

FIG. 4—Flowchart of a Method for Connecting Devices

FIG. 4 illustrates a method for using a connector block for panel mount coaxial connectors, according to some embodiments. The method shown in FIG. 4 may be used in conjunction with any of the computer systems or devices shown in the above Figures, among other devices. In various embodiments, some of the method elements shown may be performed concurrently, in a different order than shown, or may be omitted. Additional method elements may also be performed as desired. As shown, this method may operate as follows.

In 402, one or more panel mount coaxial connectors may be installed in a connector block. As described above, the connector block may include one or more connector slots, where each connector slot is configured to receive a respective panel mount coaxial connector of the one or more panel mount coaxial connectors, as well as one or more ground pads. As noted above, each ground pad may be proximate to a respective connector slot. In some embodiments, the connector block may include a plurality of such slots (and corresponding ground pads).

As also described above, each panel mount coaxial connector may include an external connection configured to electrically connect to a respective complementary coaxial connector of a coaxial cable, and an internal connection configured to electrically connect to a respective trace on a circuit board.

In 404, the connector block may be installed on the circuit board. Note that in various embodiments, method elements 402 and 404 may be performed in different orders. In other words, method elements 402 and 404 may be performed in either order (or even simultaneously).

For each of the one or more ground pads, when the panel mount coaxial connector is inserted into the connector slot, the ground pad may provide a ground connection to a panel mount coaxial connector. Similarly, when the connector block is installed on the circuit board, the ground pad may connect to a respective specified ground point on the circuit board, thereby grounding the corresponding panel mount coaxial connector.

In 406, one or more tests may be performed on the circuit board using the one or more coaxial connectors, where during the one or more tests, the circuit board is not installed in a device, or the connector block is not installed in or on a plate of the device. In other words, use of the connector block as described herein may facilitate circuit board testing with the convenience and effectiveness of panel mount coaxial connectors without requiring that the circuit board be installed in a device or module, and while maintaining the benefits of short and well-defined ground paths for the connections.

After such testing, the method may include installing the connector block and circuit board in a device. If desired, further tests may be performed on the circuit board and/or device to validate this configuration. The device may be connectable to one or more other devices via the one or more coaxial connectors of the connector block. Accordingly, the method may further include connecting the device to at least one other device via the one or more coaxial connectors of the connector block, and operating the device in conjunction with the at least one other device, e.g., for operation, or for further testing, e.g., integrated system testing.

It should be noted that any of the features and elements described herein may be used in any combinations desired.

Although the embodiments above have been described in considerable detail, numerous variations and modifications will become apparent to those skilled in the art once the above disclosure is fully appreciated. It is intended that the following claims be interpreted to embrace all such variations and modifications.

We claim:

1. A connector block for connecting a panel mount coaxial connector to a circuit board, comprising:

an electrically conductive block, comprising:

one or more connector slots, wherein each connector slot is configured to receive a respective coaxial connector that comprises:

an external connection configured to electrically connect to a respective complementary coaxial connector of a coaxial cable; and an internal connection configured to electrically connect to a respective trace on a circuit board; and one or more ground pads, wherein each ground pad is proximate to a respective connector slot;

wherein, for each of the one or more ground pads:

when the panel mount coaxial connector is inserted into the connector slot, the ground pad provides a ground connection to a panel mount coaxial connector; and when the connector block is installed on the circuit board, the ground pad connects to a respective specified ground point on the circuit board, thereby grounding the corresponding panel mount coaxial connector.

2. The connector block of claim 1, wherein when the connector block is installed on the circuit board the one or more ground pads are connected to the respective specified ground points via conductive bonding.

3. The connector block of claim 1, wherein when the connector block is installed on the circuit board the one or more ground pads are connected to the respective specified ground points via conductive screws.

4. The connector block of claim 1, wherein the one or more panel mount coaxial connectors comprise one or more panel mount coaxial RF (radio frequency) connectors.

5. The connector block of claim 4, wherein the one or more panel mount coaxial RF connectors comprise one or more panel mount SubMiniature connectors.

6. The connector block of claim 5, wherein the one or more panel mount SubMiniature connectors comprise one or more panel mount SubMiniature version A (SMA) connectors.

7. The connector block of claim 1, wherein the one or more panel mount coaxial connectors are male connectors, and wherein the complementary coaxial connectors are female connectors.

8. The connector block of claim 1, wherein the one or more panel mount coaxial connectors are female connectors, and wherein the complementary coaxial connectors are male connectors.

9. The connector block of claim 1, wherein the one or more connector slots comprise a plurality of connector slots.

10. A method, comprising:

installing one or more panel mount coaxial connectors in a connector block;

wherein the connector block comprises:

one or more connector slots, wherein each connector slot is configured to receive a respective panel mount coaxial connector of the one or more panel mount coaxial connectors; and one or more ground pads, wherein each ground pad is proximate to a respective connector slot;

wherein each panel mount coaxial connector comprises:

an external connection configured to electrically connect to a respective complementary coaxial connector of a coaxial cable; and an internal connection configured to electrically connect to a respective trace on a circuit board;

installing the connector block on the circuit board;

wherein, for each of the one or more ground pads:

when the panel mount coaxial connector is inserted into the connector slot, the ground pad provides a ground connection to a panel mount coaxial connector; and when the connector block is installed on the circuit board, the ground pad connects to a respective specified ground point on the circuit board, thereby grounding the corresponding panel mount coaxial connector; and performing one or more tests on the circuit board using the one or more panel mount coaxial connectors, wherein during the one or more tests, the circuit board is not installed in a device, or the connector block is not installed in or on a plate of the device.

11. The method of claim 10, further comprising:

installing the connector block and circuit board in a device, wherein the device is connectable to one or more other devices via the one or more panel mount coaxial connectors of the connector block.

12. The method of claim 11, further comprising:

connecting the device to at least one other device via the one or more panel mount coaxial connectors of the connector block; and operating the device in conjunction with the at least one other device.

13. The connector block of claim 10, wherein when the connector block is installed on the circuit board the one or more ground pads are connected to the respective specified ground points via conductive bonding.

14. The connector block of claim 10, wherein when the connector block is installed on the circuit board the one or more ground pads are connected to the respective specified ground points via conductive screws.

15. The connector block of claim 10, wherein the one or more panel mount coaxial connectors comprise one or more panel mount RF (radio frequency) connectors.

16. The connector block of claim 15, wherein the one or more panel mount coaxial RF connectors comprise one or more panel mount SubMiniature connectors.

17. The connector block of claim 16, wherein the one or more panel mount SubMiniature connectors comprise one or more panel mount SubMiniature version A (SMA) connectors.

18. The connector block of claim 10, wherein the one or more panel mount coaxial connectors are male connectors, and wherein the complementary coaxial connectors are female connectors.

19. The connector block of claim 10, wherein the one or more panel mount coaxial connectors are female connectors, and wherein the complementary coaxial connectors are male connectors.

20. The connector block of claim 10, wherein the one or more connector slots comprise a plurality of connector slots.

* * * * *